US006053179A

United States Patent [19]

Lhuisset

[11] Patent Number: 6,053,179

[45] Date of Patent: Apr. 25, 2000

[54] BRUSH FOR THE APPLICATION OF A LIQUID PASTY OR POWDERY PRODUCT SUCH AS MASCARA

[75] Inventor: François Lhuisset, Montgeron, France

[73] Assignee: LVMH Recherche, Nanterre, France

[21] Appl. No.: 09/180,103

[22] PCT Filed: May 14, 1997

[86] PCT No.: PCT/FR97/00859

§ 371 Date: Aug. 12, 1999

§ 102(e) Date: Aug. 12, 1999

[87] PCT Pub. No.: WO97/42850

PCT Pub. Date: Nov. 20, 1997

[30] Foreign Application Priority Data

May 15, 1999 [FR] France ..... 96 06099

[51] Int. Cl.[7] ..... A46B 11/02; A45D 40/26

[52] U.S. Cl. ..... 132/218; 401/290; 401/129; 132/142

[58] Field of Search ..... 132/218, 109, 132/116, 112, 142; 401/290, 129, 282, 284, 288

[56] References Cited

U.S. PATENT DOCUMENTS

| | | | |
|---|---|---|---|
| 780,640 | 1/1905 | Thomas | 132/142 |
| 1,130,442 | 3/1915 | Speese | 401/290 |
| 3,908,676 | 9/1975 | Levine et al. | 132/218 |
| 4,662,385 | 5/1987 | Schefer | 132/218 |
| 5,027,838 | 7/1991 | Iaia et al. | 132/218 |
| 5,865,556 | 2/1999 | Lhuisset | 132/218 |

FOREIGN PATENT DOCUMENTS

| | | | |
|---|---|---|---|
| 2363299 | 3/1978 | France | 132/218 |

*Primary Examiner*—Todd E. Manahan
*Attorney, Agent, or Firm*—Leydig, Voit & Mayer, Ltd.

[57] ABSTRACT

The present invention relates to an improved brush for the application of a liquid, pasty or powdery product. The brush has an active portion comprised of a split tube which houses an insert disposed therein. The insert is configured like a split cylinder having free ends projecting from the slit in the split tube. At least one of the free ends of the split cylinder comprises teeth formed therewith to form a comb suitable for applying the product. The brush can be used to apply mascara to the eyelashes

6 Claims, 1 Drawing Sheet

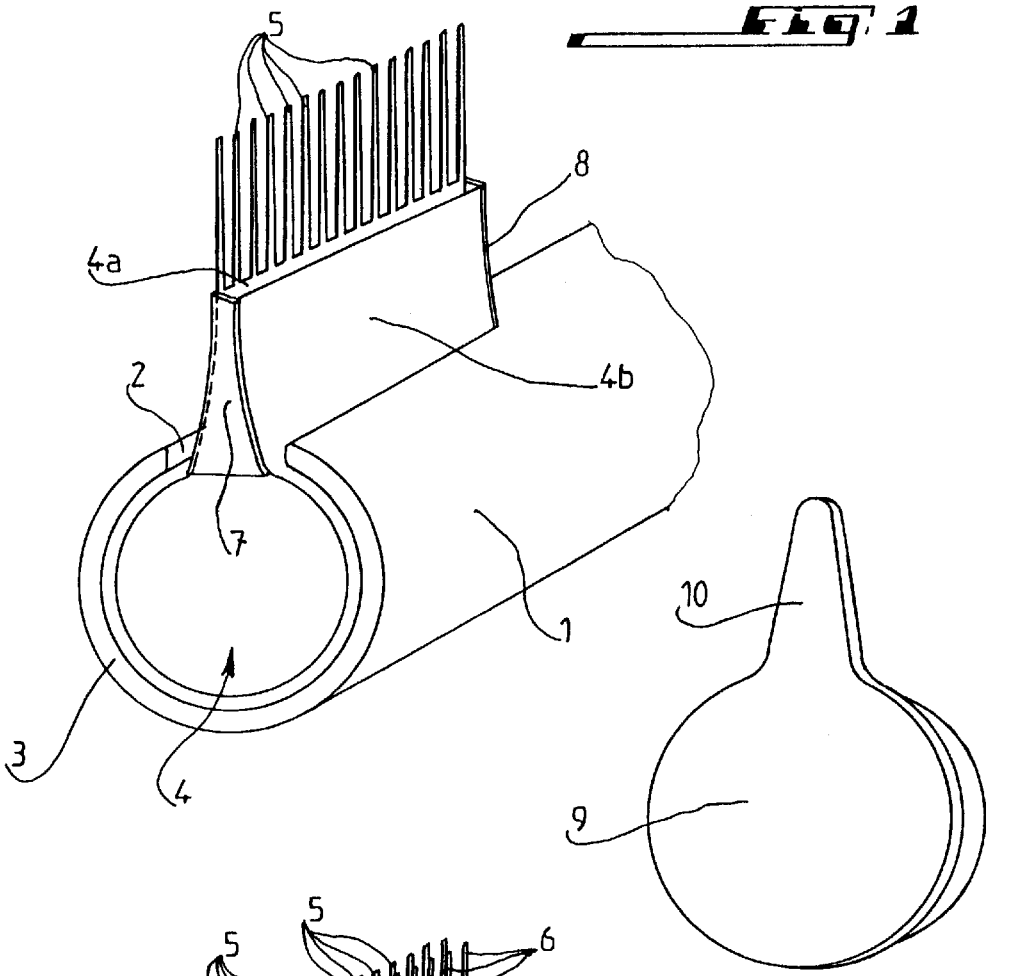
Fig. 1
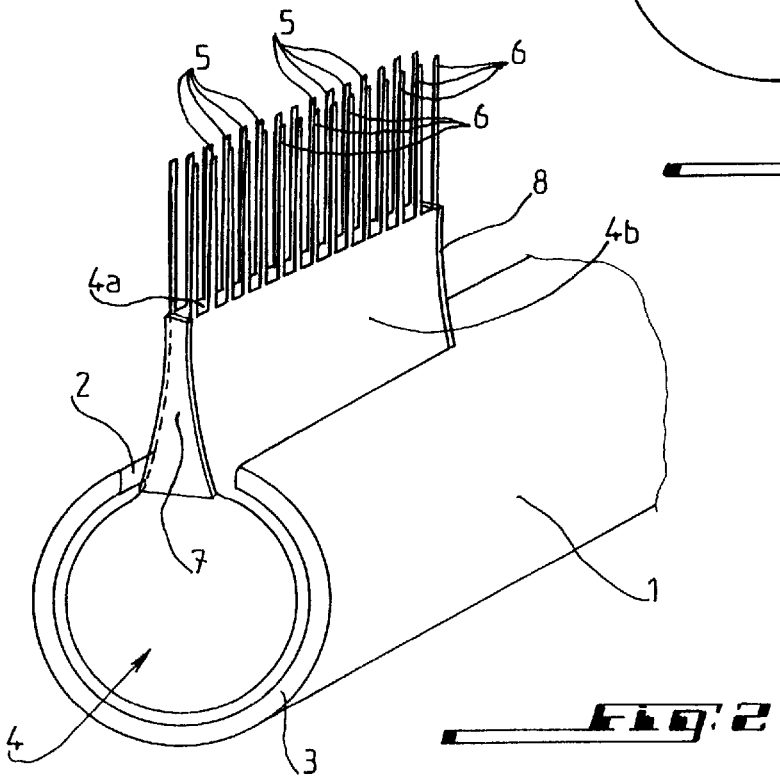
Fig. 3
Fig. 2

BRUSH FOR THE APPLICATION OF A LIQUID PASTY OR POWDERY PRODUCT SUCH AS MASCARA

The subject of the invention is essentially an improved brush for application of a liquid, paste, or powdery product of any kind whatsoever, for example, mascara.

Various structures have already been proposed for brushes for applying mascara, which generally comprise a shaft in the form of a tube that is slit along at least one generatrix and that is connected to a handle that forms the product reservoir, wherein said tube contains an insert in the form of a split cylinder whose free edges project from the slit in the tube.

Applied around the insert are flexible filaments whose free ends project from the slit in the tube between said slit and the free edges of the insert to thereby constitute the bristles of the brush.

However, it has been shown that manufacturing problems may arise with such a brush structure, wherein the assembly of the various constituent elements remains tricky.

In addition, the aim of the invention is specifically to remedy this type of problem by proposing an improved brush structure comprising a minimum number of components, one that is less expensive and permits particularly efficient application of any type of product, for example, mascara, to be applied to the eyelashes.

To that end, the object of the invention is a brush for application of a liquid, paste, or powdery product such as mascara in particular, and of the type that comprises a shaft in the form of a tube that is slit along at least one generatrix and is connected to a handle forming the reservoir, and in which tube is housed an insert in the shape of a split cylinder whose free edges project from the slit in the tube, characterized by the fact that at least one of the opposing free edges of the split cylinder contains teeth or the like made of the same material as it is and forming a comb that is capable of permitting application of the product.

It is already clear that the brush according to the invention is particularly easy to manufacture by virtue of the fact that it is limited to essentially two parts: the split tube and the toothed insert housed in the tube.

According to another embodiment, each of the two free edges of the split cylinder projecting from the slit in the tube has teeth so as thereby to form a double comb.

The brush according to the invention is further characterized by the fact that the gap between the opposing free edges of the split cylinder projecting from the slit in the tube is sealed at the end of such edges by plates or the like, while the end of the split tube receiving the insert is sealed by a plug or the like.

According to another embodiment, the end of the split tube receiving the insert is sealed by a plug or the like with an ear that seals the gap between the opposing free edges of the split cylinder on one side of the cylinder, while on the other side of the cylinder said gap is sealed by a plate or the like.

But other characteristics and advantages of the invention will become clearer in the detailed description that follows with reference to the attached drawings given by way of example only, where:

FIG. 1 is a perspective view of part of the shaft of the brush according to the invention, the end of which is not sealed with a plug, for greater clarity.

FIG. 2 is a view similar to the above except that it shows a variant of the brush, namely a brush forming a double comb, while the brush illustrated in FIG. 1 is a brush with a single comb.

FIG. 3 is a schematized perspective view of a plug with an ear that seals the brush shaft end.

With reference specifically to FIGS. 1 and 2, one sees a brush that is made up essentially of shaft 1 in the form of a tube split along at least one generatrix, the slit in the tube being formed at 2.

Split shaft or tube 1, of which open end 3 is visible, is connected at its opposite end to a handle (not shown) forming a reservoir for any type of liquid, paste, or powdery product to be applied.

Housed in tube 1, as clearly shown in the figures, is insert 4 in the form of a split cylinder whose free edges 4*a*, 4*b* project from tube 1 through slit 2 cut into the tube.

All the above arrangements are known, pursuant to Patent No. 94/5718 held by the applicant and to which one may refer.

According to the invention, and as shown clearly in FIG. 1, one (4*a*) of the opposing free edges 4*a*, 4*b* of insert or split cylinder 4 has teeth or the like 5, which are made of the same material or cast with said insert or split cylinder 4 to form a comb suitable for permitting application of the product flowing between said free edges 4*a* and 4*b*.

In the embodiment illustrated in FIG. 2, one sees that not only free edge 4*a* has teeth 5, but free edge 4*b* also has teeth 6 made of the same material with it, so as thereby to form two lines of teeth that constitute a type of double comb.

Teeth 5 and 6 may be of any suitable length, and also of whatever thickness or with any spacing between them, of course, as a function of the product to be applied and the desired results.

Two plates 7 and 8 or the like are shown at the ends of edges 4*a*, 4*b* sealing the interval between such edges projecting from slit 2 in tube 1. Thus, the product to be delivered between free edges 4*a*, 4*b* will be kept between such edges without allowing it to escape, as is understood.

End 3 of split tube 1 will, of course, also be sealed by a circular plug (not shown) capable of completing the seal formed by plate 7.

It may be observed here that plates 7 and 8 may consist of any component of any appropriate shape and fastened in any manner to the ends of free edges 4*a*, 4*b* of split insert 4.

According to an embodiment variant of the seal described above, plate 8 remains the same, while plate 7, on open end 3 of split tube 1, will be omitted, and said end 3 will be sealed by a plug with an ear as shown in FIG. 3.

9 designates the part of the plug that, strictly speaking, seals end 3 of split tube 1, and 10 designates the ear that serves as plate 7 to seal the gap at end 3 side of tube 1 between free edges 4*a*, 4*b* of insert or split cylinder 4.

Thus, according to the invention, an improved brush has been provided in the form of a comb which uses a minimum number of components; it is particularly simple and inexpensive to make, and permits application of any type of product, for example, a cosmetic product, in an efficient and precise manner and with the desired even distribution of the product due to the presence of teeth that form either a single or double comb.

Of course, the invention is in no way limited to the embodiments described and illustrated, which are given by way of example only.

The invention accordingly includes all technical equivalents of the means described as well as any combination thereof, as long as they are included the scope of the following claims.

I claim:

1. A brush for application of a liquid, paste, or powdery product, comprising a tube with a longitudinal slot, the tube forming a handle and a reservoir for the product, and a split cylinder inserted in the tube and having edges projecting through the slot in the tube, one of the edges of the split cylinder having teeth forming a comb for application of the product.

2. The brush according to claim 1, wherein two edges of the split cylinder project from the slot in the tube and each of the edges has teeth, thereby forming a double comb.

3. The brush according to claim 2, wherein a gap between the two edges that project from the slot in the tube is sealed at ends of the edges by plates and including a plug sealing an end of the tube receiving the cylinder.

4. The brush according to claim 2, including a plug sealing a first end of the tube receiving the cylinder, the plug having a tab sealing a gap between the two edges of the split cylinder at one end of the split cylinder, and a plate sealing a second end of the split cylinder.

5. The brush according to claim 1, wherein a gap between the edges that project from the slot in the tube is sealed at ends of the edges by plates and including a plug sealing an end of the tube receiving the cylinder.

6. The brush according to claim 1, including a plug sealing a first end of the tube receiving the cylinder, the plug having a tab sealing a gap between the edges of the split cylinder at one end of the split cylinder, and a plate sealing a second end of the split cylinder.

* * * * *

UNITED STATES PATENT AND TRADEMARK OFFICE

CERTIFICATE OF CORRECTION

PATENT NO. : 6,053,179

DATED : April 25, 2000

INVENTOR(S) : Francois Lhuisset

It is certified that error appears in the above-indentified patent and that said Letters Patent is hereby corrected as shown below:

Title page, item [30] Change "May 15, 1999" to --May 15, 1996--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*